US009943198B2

(12) United States Patent
Yang

(10) Patent No.: US 9,943,198 B2
(45) Date of Patent: Apr. 17, 2018

(54) ONE-TOUCH QUICK-RELEASE DEVICE OF TOILET COVER

(71) Applicant: Lottery (Xiamen) Sanitary Ware Co., Ltd., Xiamen (CN)

(72) Inventor: Xiwen Yang, Xiamen (CN)

(73) Assignee: LOTTERY (XIAMEN) SANITARY WARE CO., LTD., Xiamen, Fujian (CN)

( * ) Notice: Subject to any disclaimer, the term of this patent is extended or adjusted under 35 U.S.C. 154(b) by 171 days.

(21) Appl. No.: 14/948,401

(22) Filed: Nov. 23, 2015

(65) Prior Publication Data

US 2017/0049281 A1 Feb. 23, 2017

(30) Foreign Application Priority Data

Aug. 17, 2015 (CN) ..... 2015 2 0617648 U

(51) Int. Cl.

| | |
|---|---|
| ***A47K 13/14*** | (2006.01) |
| ***A47K 13/12*** | (2006.01) |
| ***A47K 13/26*** | (2006.01) |

(52) U.S. Cl.

CPC ..... *A47K 13/12* (2013.01); *A47K 13/26* (2013.01)

(58) Field of Classification Search

CPC ..... A47K 13/12; A47K 13/26
USPC ..... 4/236, 240, 242.1
See application file for complete search history.

(56) References Cited

U.S. PATENT DOCUMENTS

| | | | | | |
|---|---|---|---|---|---|
| 2,032,257 | A * | 2/1936 | Carmichael | A47K 13/12 | 16/365 |
| 4,817,215 | A * | 4/1989 | Stewart | A47K 13/12 | 16/341 |
| 8,122,523 | B2 * | 2/2012 | Li | A47K 13/12 | 4/236 |
| 2013/0117919 | A1 * | 5/2013 | Peng | A47K 13/12 | 4/236 |
| 2015/0320270 | A1 * | 11/2015 | Song | A47K 13/26 | 4/242.1 |

FOREIGN PATENT DOCUMENTS

| | | | | |
|---|---|---|---|---|
| CN | 201968594 | * | 9/2011 | A47K 13/26 |
| CN | 204091871 | * | 1/2015 | A47K 13/12 |
| CN | 204351748 | * | 5/2017 | A47K 13/26 |
| WO | WO2013022409 | * | 2/2013 | A47K 13/12 |

* cited by examiner

*Primary Examiner* — Erin Deery
*Assistant Examiner* — Nicholas Ros
(74) *Attorney, Agent, or Firm* — Leong C. Lei

(57) ABSTRACT

A one-touch quick-release device of a toilet cover is provided. One end of a connecting member is installed to the toilet cover through a turning member, and another end of the connecting member is connected with an engaging member. A return elastic member is provided between the engaging member and the connecting member. The connecting member is radially provided with an insertion rod. The retaining member is vertically provided with a support rod. The support rod is formed with a central hole for insertion of the insertion rod. An upper end of the support rod is provided with an annular flange. The engaging member is provided with an annular through trough. The annular flange is inserted through the annular through trough to lean against the connecting member. The insertion rod of the connecting member is inserted into the central hole of the support rod.

7 Claims, 9 Drawing Sheets

ONE-TOUCH QUICK-RELEASE DEVICE OF TOILET COVER

BACKGROUND OF THE INVENTION

1. Field of the Invention

The present invention relates to a one-touch quick-release device of a toilet cover.

2. Description of the Prior Art

European Patent Publication No. EP1199020B1 discloses a toilet seat assembly installed on a toilet ceramic body, which comprise a damper device, an adapter, and a fastening device. The fastening device is fixed on the toilet ceramic body. The fastening device is provided with a shaft head. The adapter is connected with the damper device. The damper device is used to support the pivotal turning of the toilet cover, namely, the toilet cover is installed on the damper device in a pivotal way. The adapter is formed with a radial blind bore for insertion of the shaft head of the fastening device.

The toilet seat assembly limits the transverse movement and vertical movement of the adapter and the damper device as well as the turning of the adapter and the damper device through the shaft head of the fastening device to be inserted into the radial blind bore of the adapter. In order to limit the radial movement of the shaft head, the shaft head is formed with an engaging recess. An engaging spring is provided with in the engaging recess. Through the engaging spring engaged in the engaging recess to limit the radial movement of the shaft head, the shortcoming is that the engaging spring is easily deformed during use to lose its engaging function. As a result, it is unable to limit the radial movement of the shaft head. The rigid hardness of the engaging spring is not enough, so it may be bent with ease. Accordingly, the inventor of the present invention has devoted himself based on his many years of practical experiences to solve these problems.

SUMMARY OF THE INVENTION

The primary object of the present invention is to provide a one-touch quick-release device of a toilet cover to disassemble for the toilet cover to be pivoted steady and not to disengage from the toilet seat. The strength of the whole structure is better.

In order to achieve the aforesaid object, the one-touch quick-release device of the present invention comprises a connecting member, a retaining member, a drive member, an engaging member, and a turning member. One end of the connecting member is installed to the toilet cover through the turning member, and another end of the connecting member is connected with the engaging member. A return elastic member is provided between the engaging member and the connecting member. The connecting member is radially provided with an insertion rod. The retaining member is installed on a toilet. The retaining member is vertically provided with a support rod. The support rod is formed with a central hole for insertion of the insertion rod. An upper end of the support rod is provided with an annular flange. The engaging member is provided with an annular through trough. The annular flange at the upper end of the support rod is inserted through the annular through trough to lean against the connecting member. The insertion rod of the connecting member is inserted into the central hole of the support rod. The engaging member is biased by the return elastic member or is compressed by the drive member to axially move back and forth on the connecting member.

Along with an axial displacement of the engaging member, an edge of the annular through trough of the engaging member is engaged with a lower portion of the annular flange of the support rod for the connecting member to be retained on the support rod or is released from the lower portion of the annular flange of the support rod for the connecting member to disengage from the support rod.

Preferably, the central hole of the support rod is provided with a push elastic member to support the insertion rod inserted into the central hole of the support rod.

Preferably, the central hole of the support rod is a through hole. The bottom of the through hole is provided with a bottom lid. The push elastic member is disposed in the through hole. One end of the push elastic member leans against the bottom lid, and another end of the push elastic member leans against the insertion rod of the connecting member for supporting the insertion rod inserted into the central hole of the support rod.

Preferably, the annular flange of the support rod is a conical frustum configuration, and an upper portion of the annular flange has a smaller diameter than that of a lower portion of the annular flange.

Preferably, the support rod has a rod body beneath a lower portion of the annular flange. The rod body has a conical frustum shape. The rod body is gradually enlarged from the lower portion the annular flange to a bottom thereof.

Preferably, the drive member comprises a sleeve and a button. The connecting member is installed in the sleeve. The engaging member is moveably installed in the sleeve. The sleeve is provided with an opening. The button is confined and installed in the opening. An elastic member is provided between the button and the sleeve. The button is provided with a first push portion. The engaging member is provided with a second push portion to mate with the first push portion. The sleeve is provided with an aperture for insertion of the support rod of the retaining member.

Preferably, the first push portion of the button is an inclined wedge. The second push portion of the engaging member is an inclined surface to lean against the first push portion.

Preferably, the connecting member is axially cut to form a stepped surface. The insertion rod of the connecting member is disposed on the stepped surface and perpendicular to the stepped surface. The annular flange of the support rod is inserted through the annular through trough to lean against the stepped surface of the connecting member.

Preferably, the connecting member is provided with a limit engaging recess and a limit slide recess which are arranged up and down. The engaging member is provided with a limit engaging strip and an engaging plate which are arranged up and down. The limit engaging strip is provided with an engaging hook. The side wall of the limit engaging recess is provided with an engaging hole. The limit engaging strip of the engaging member is inserted into the limit engaging recess. The engaging hook is engaged in the engaging hole. The engaging plate is formed with the annular through trough. A free end of the engaging plate is inserted into the limit slide recess.

Preferably, an upper portion of the edge of the annular through trough of the engaging member has an inclined chamfer.

Accordingly, the insertion rod of the connecting member of the present invention is inserted into the central hole of the support rod to limit the horizontal movement of the connecting member. An upper end face of the annular flange of the support rod is to support the connecting member, enabling the connecting member to be installed more firmly.

The annular through trough of the engaging member is engaged with the annular flange of the support rod to limit the vertical movement of the connecting member and to prevent disengagement of the connecting member and the retaining member. Thereby, the toilet cover can be pivoted steady and won't disengage from the toilet seat easily. The strength of the whole structure is better.

DETAILED DESCRIPTION OF THE PREFERRED EMBODIMENTS

Embodiments of the present invention will now be described, by way of example only, with reference to the accompanying drawings.

Figure 1:
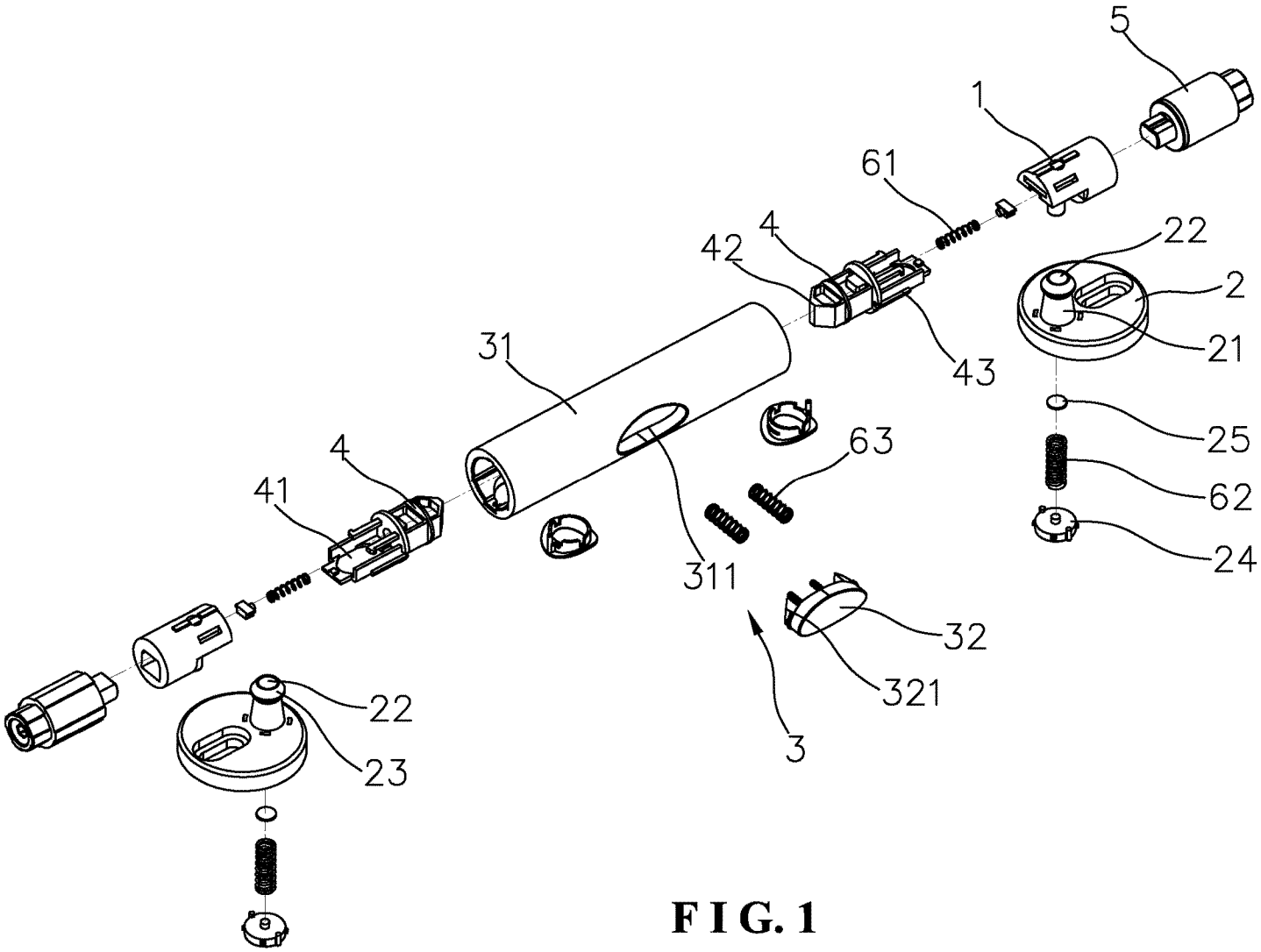
FIG. 1 is an exploded view of the present invention.
Figure 2:
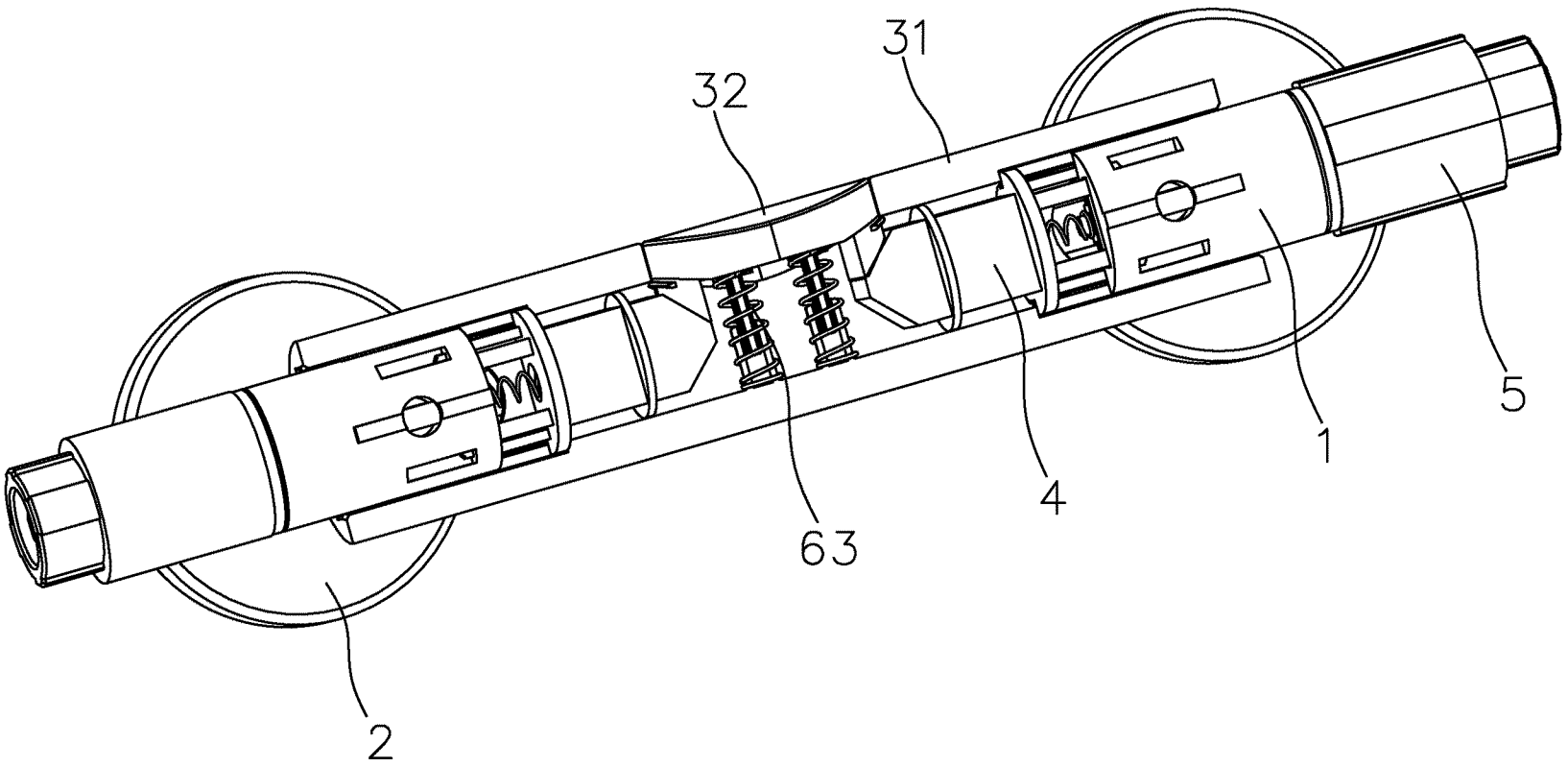
FIG. 2 is a perspective view of the present invention (the sleeve is sectioned)
Figure 3:
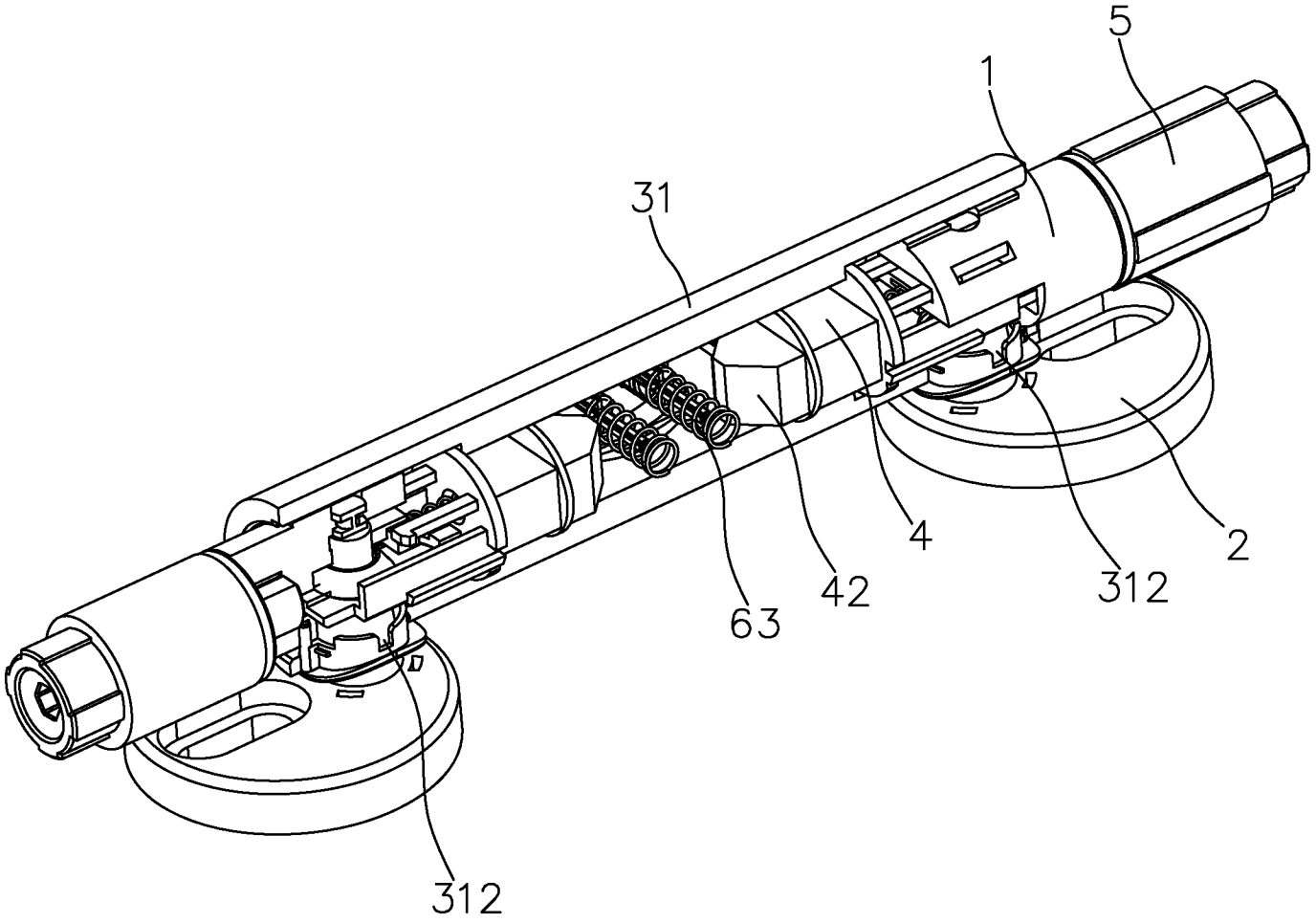
FIG. 3 is another perspective view of the present invention (the sleeve is sectioned)
Figure 4:
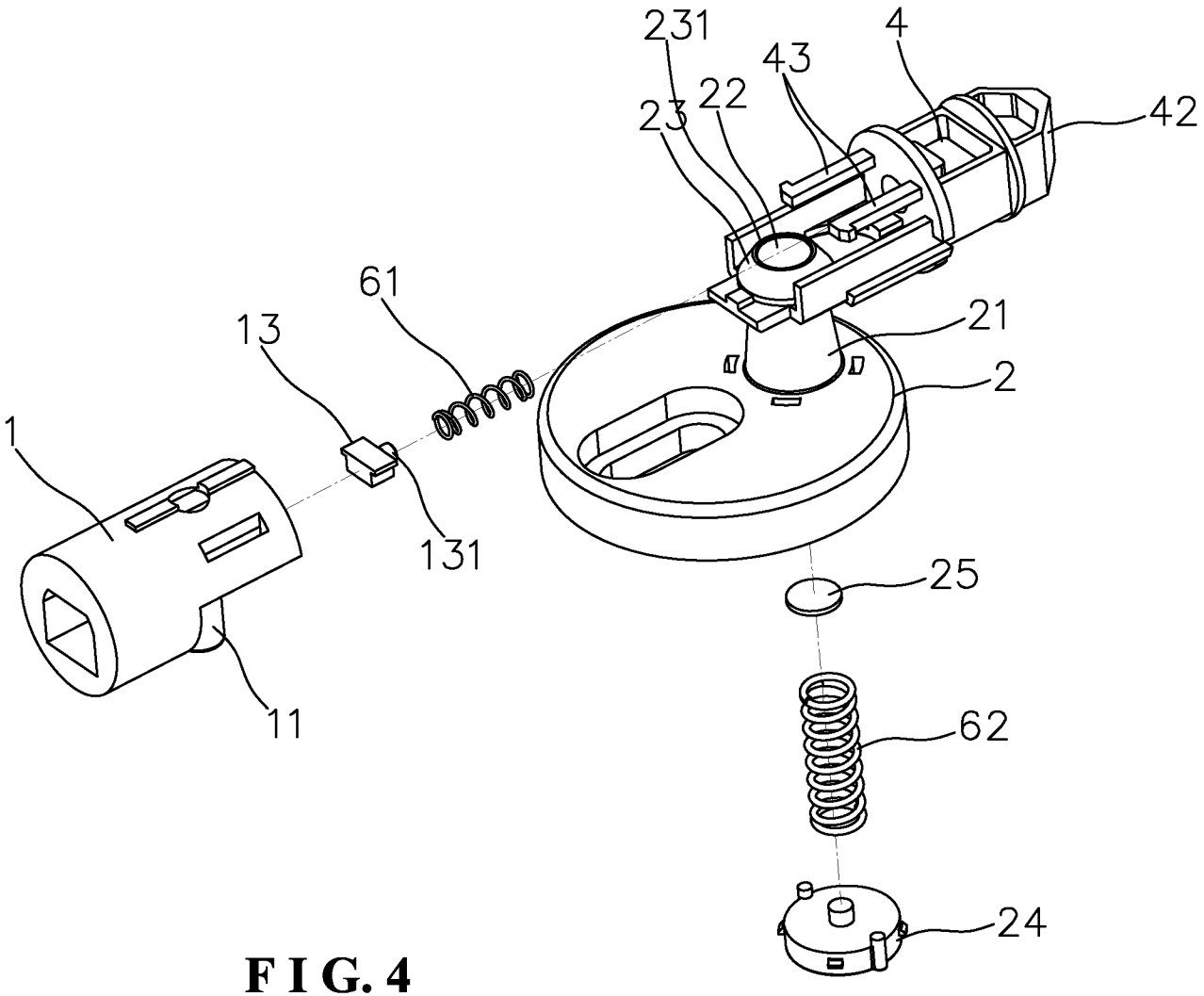
FIG. 4 is a partial exploded view of the present invention.
Figure 5A:
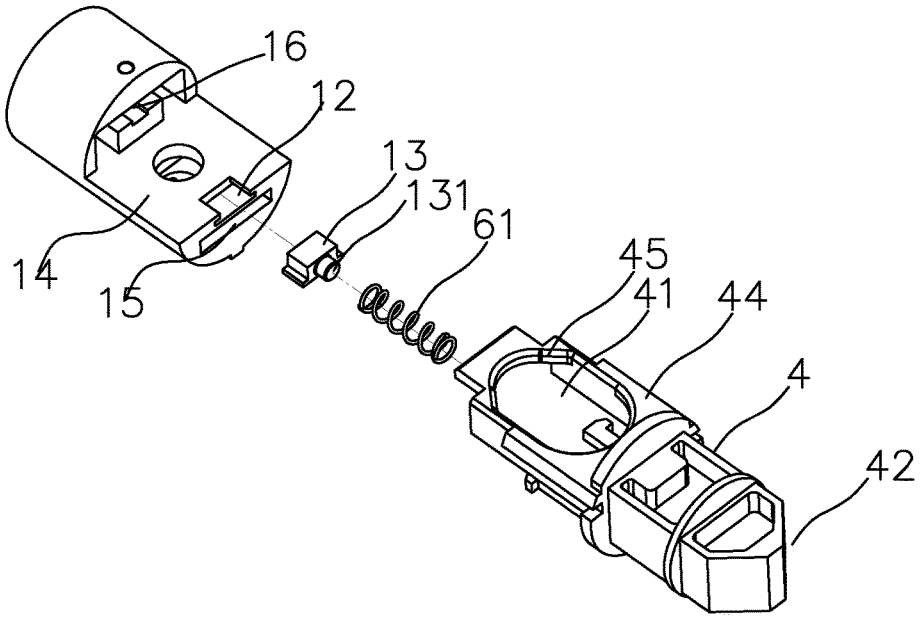
FIG. 5*a* is a schematic view of the engaging member and the connecting member of the present invention.
Figure 5B:
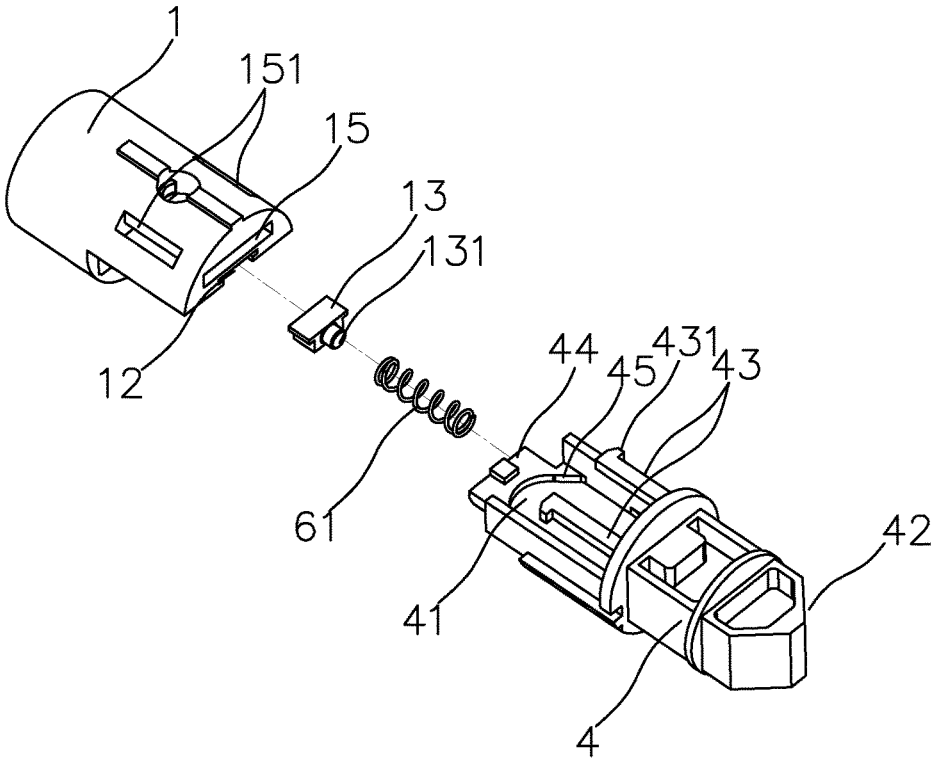
FIG. 5*b* is another schematic view of the engaging member and the connecting member of the present invention.
Figure 6A:
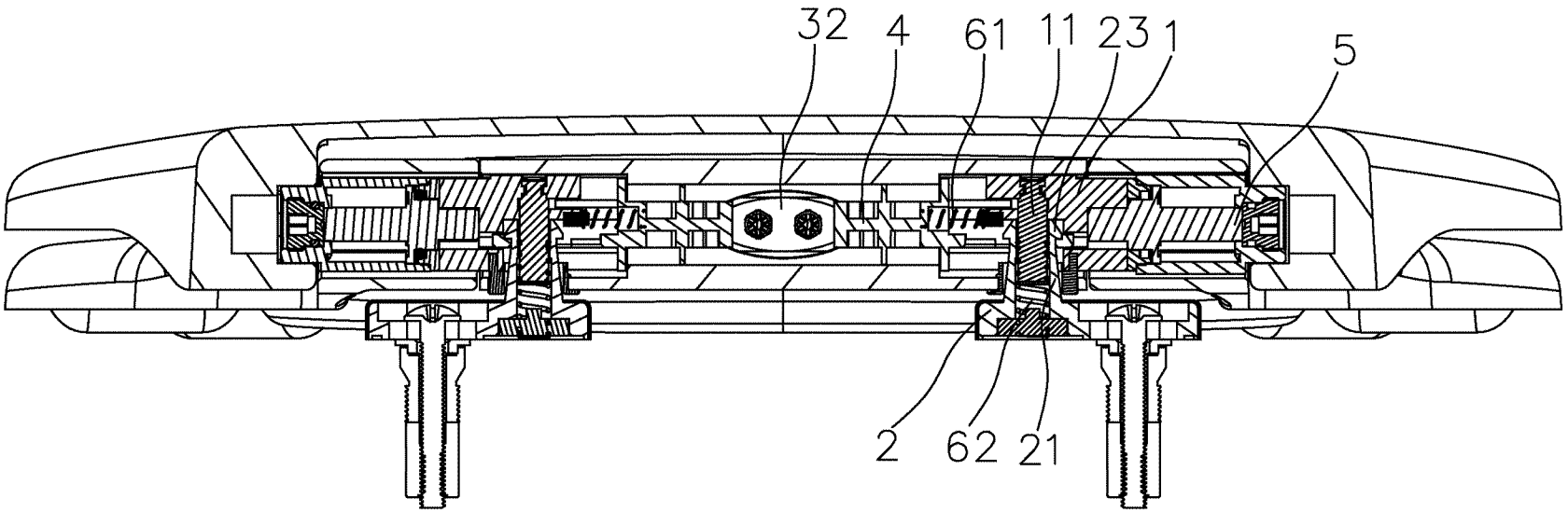
FIG. 6*a* is a sectional view of the present invention (in an engagement state)
Figure 6B:
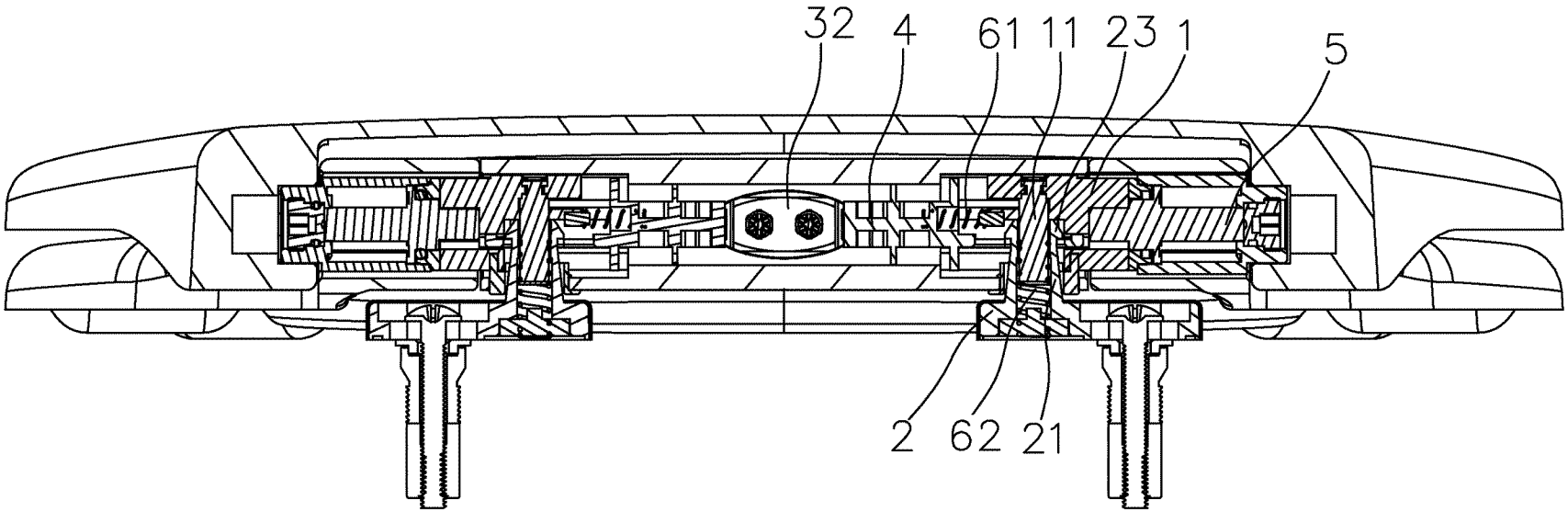
FIG. 6*b* is a sectional view of the present invention (in a disengagement state)
Figure 7A:
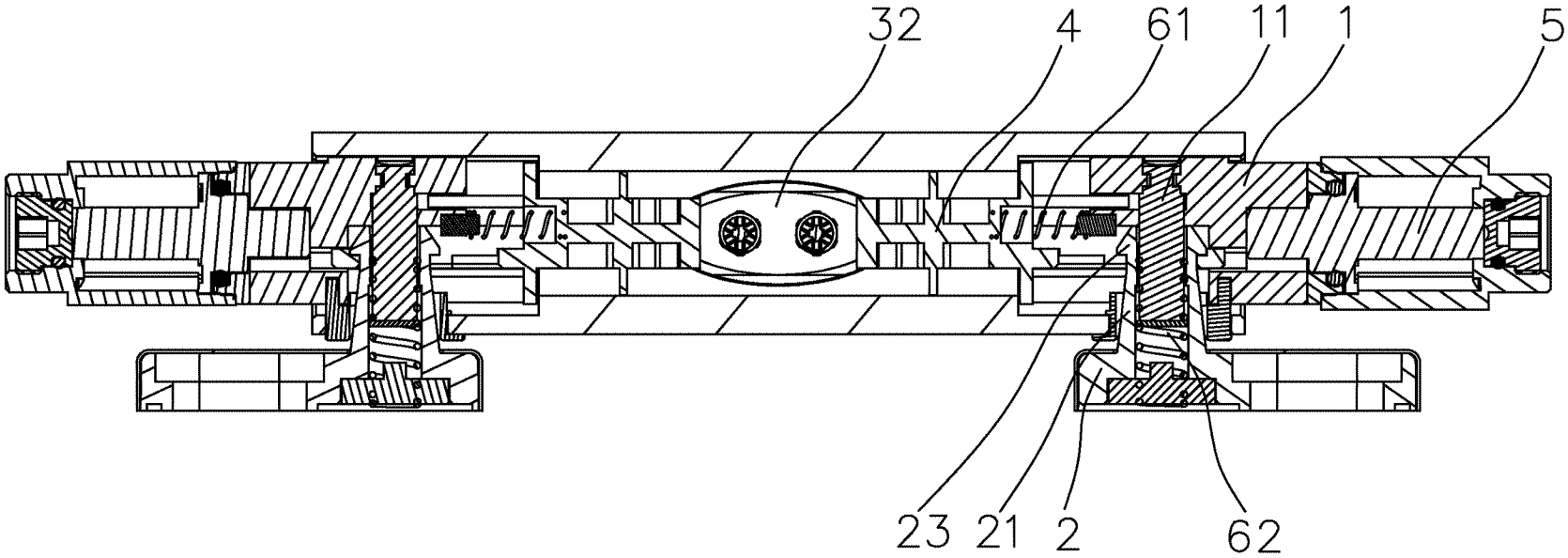
FIG. 7*a* is a sectional view of the present invention seen from another angle (in an engagement state)
Figure 7B:
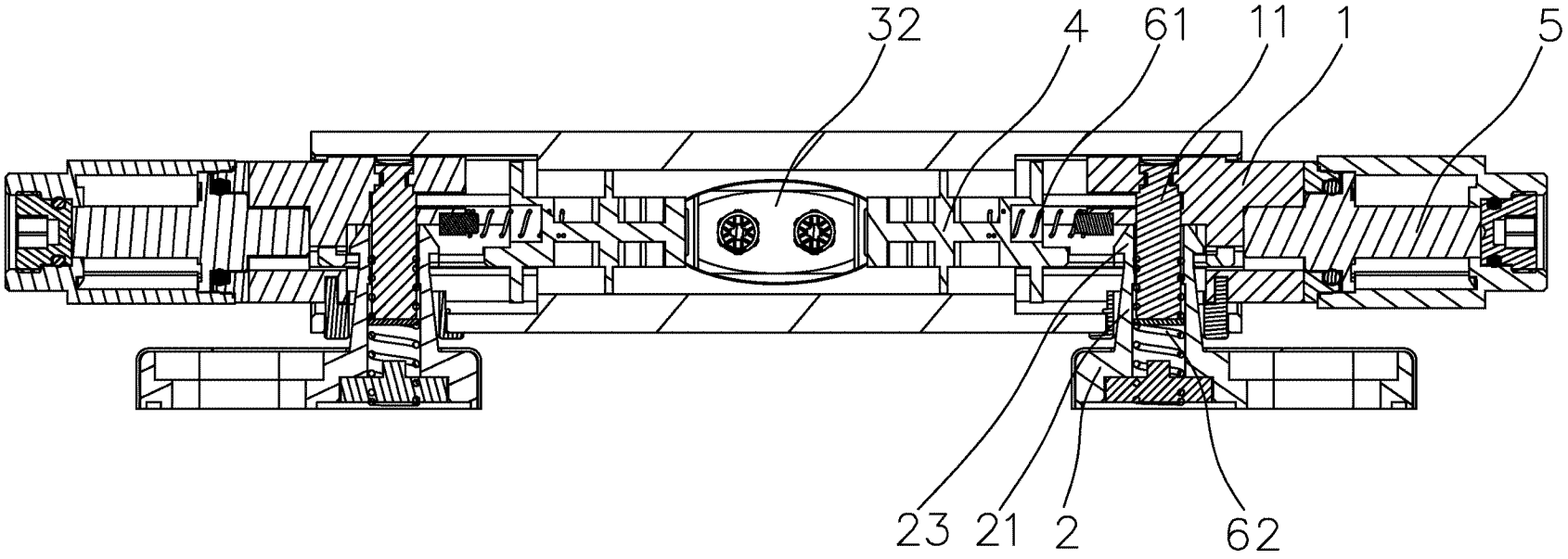
FIG. 7*b* is a sectional view of the present invention seen from another angle (in a disengagement state).

As shown in FIG. 1 through FIG. 7*b*, the present invention discloses a one-touch quick-release device of a toilet cover. The one-touch quick-release device comprises a connecting member 1, a retaining member 2, a drive member 3, an engaging member 4, and a turning member 5.

One end of the connecting member 1 is installed to a toilet cover through the turning member 5. The turning member is a damper. Another end of the connecting member 1 is connected with the engaging member 4. A return elastic member 61 is provided between the engaging member 4 and the connecting member 1. The return elastic member 61 is a spring. The connecting member 1 is radially provided with an insertion rod 11, as show in FIG. 4.

In this embodiment, the installation of the return elastic member 61 is described hereinafter. The connecting member 1 is provided with a trough 12. The trough 12 is adapted to receive an insertion block 13. The insertion block 13 is provided with a positioning post 131. One end of the return elastic member 61 is held on the positioning post 131 of the insertion block 13, and another end of the return elastic member 61 leans against the engaging member 4.

The retaining member 2 is installed on the toilet (not shown in the drawings). The retaining member 2 is fixedly installed on a toilet ceramic body of the toilet. The retaining member 2 is vertically provided with a support rod 21. The support rod 21 is formed with a central hole 22 for insertion of the insertion rod 11.

An upper end of the support rod 21 is provided with an annular flange 23. The engaging member 4 is provided with an annular through trough 41. The annular flange 23 at the upper end of the support rod 21 is inserted through the annular through trough 41 to lean against the connecting member 1. The insertion rod 11 of the connecting member 1 is inserted into the central hole 22 of the support rod 21. The engaging member 4 is biased by the return elastic member 61 or is compressed by the drive member 3 to axially move back and forth on the connecting member 1. Along with the axial displacement of the engaging member 4, the edge of the annular through trough 41 of the engaging member 4 is engaged with a lower portion of the annular flange 23 of the support rod 21 for the connecting member 1 to be retained on the support rod 21 or is released from the lower portion of the annular flange 23 of the support rod 21 for the connecting member 1 to disengage from the support rod 21.

The engaging member 4 biased by the return elastic member 61 is axially displaced away from the connecting member 1. Along with the axial displacement of the engaging member 4, the edge of the annular through trough 41 of the engaging member 4 is engaged with the lower portion of the annular flange 23 of the support rod 21 for the connecting member 1 to be retained on the support rod 21. The engaging member 4 is compressed by the drive member 3 to be released from the lower portion of the annular flange 23 of the support rod 21 for the connecting member 1 to disengage from the support rod 21.

Along with the axial displacement of the engaging member 4, the edge of the annular through trough 41 of the engaging member 4 is engaged with the lower portion of the annular flange 23 of the support rod 21. The curved edge of the annular through trough 41 forms a U-shaped binding relative to the rod body of the support rod 21, such that the annular flange 23 of the support rod 21 is securely engaged between the connecting member 1 and the engaging member 4 so as to retain the connecting member 1 on the support rod 21.

The insertion rod 11 of the connecting member 1 of the present invention is inserted into the central hole 22 of the support rod 2 to limit the horizontal movement of the connecting member 1. An upper end face 231 of the annular flange 23 of the support rod 2 is to support the connecting member 1, enabling the connecting member 1 to be installed more firmly. The annular through trough 41 of the engaging member 4 is engaged with the annular flange 23 of the support rod 21 to limit the vertical movement of the connecting member 1 and to prevent disengagement of the connecting member 1 and the retaining member 2. Thereby, the toilet cover can be pivoted steady and won't disengage from the toilet seat easily. The strength of the whole structure is better.

The central hole 22 of the support rod 21 is provided with a push elastic member 62 to support the insertion rod 11 inserted into the central hole 22 of the support rod 21. In this embodiment, the central hole 22 of the support rod 21 is a through hole. The bottom of the through hole is provided with a bottom lid 24. The push elastic member 62 is disposed in the through hole. One end of the push elastic member 62 leans against the bottom lid 24, and another end of the push elastic member 62 leans against the insertion rod 11 of the connecting member 1 through a spacer 25 for supporting the insertion rod 11 inserted into the central hole 22 of the support rod 21.

When the connecting member 1 is retained on the support rod 21, the insertion rod 11 is inserted into the central hole 22 of the support rod 21 to compress the push elastic member 62. The push elastic member 62 generates a reaction force to tighten the retaining member 2 and the engaging member 4. When the user wants to disassemble the toilet cover from the toilet seat, the drive member 3 forces the engaging member 4 to axially displace toward the connecting member 1. When the edge of the annular through trough 41 of the engaging member 4 is released from the lower portion of the annular flange 23 of the support rod 21, the push elastic member 62 provides a return force to the insertion rod 11, enabling the annular flange 23 of the support rod 21 to disengage from the annular through trough 41 of the engaging member 4, such that the connecting member 1 disengages from the support rod 21. Thereby, the toilet cover bounces up from the retaining member 2.

The annular flange 23 of the support rod 21 is a conical frustum configuration. An upper portion of the annular flange 23 has a smaller diameter than that of a lower portion of the annular flange 23. When the toiled cover is installed, the annular flange 23 is inserted through the annular through trough 41 of the engaging member 4, and the edge of the annular through trough 41 is compressed by the inclined side wall of the conical frustum to force the engaging member 4 to move axially toward the connecting member 1, and the return elastic member 61 between the engaging member 4 and the connecting member 1 is compressed. When the annular flange 23 fully extends out of the annular through trough 41 to lean against the connecting member 1, the engaging member 4 biased by the return elastic member 61 is axially moved away from the connecting member 1, and the edge of the annular through trough 41 of the engaging member 4 is engaged with the lower portion of the annular flange 23 of the support rod 21 along with the axial displacement of the engaging member 4.

The support rod 21 has a rod body beneath a lower portion the annular flange 23. The rod body has a conical frustum shape, which is gradually enlarged from the lower portion of the annular flange 23 to the bottom thereof. It can bear the weight of the toile cover and won't be broken off.

In this embodiment, the drive member 3 comprises a sleeve 31 and a button 32. The connecting member 1 is installed in the sleeve 31. The engaging member 4 is moveably installed in the sleeve 31. The sleeve 31 is provided with an opening 311. The button 32 is confined and installed in the opening 311 for pressing conveniently. An elastic member 63 is provided between the button 32 and the sleeve 31. The button 32 is provided with a first push portion 321. The engaging member 4 is provided with a second push portion 42 to mate with the first push portion 321. The sleeve 31 is provided with an aperture 312 for insertion of the support rod 21 of the retaining member 2. The first push portion 321 of the button 32 is an inclined wedge. The second push portion 42 of the engaging member 4 is an inclined surface to lean against the first push portion 321.

The connecting member 1 is axially cut to form a stepped surface 14. The insertion rod 11 of the connecting member 1 is disposed on the stepped surface 14 and perpendicular to the stepped surface 14. The annular flange 23 of the support rod 21 is inserted through the annular through trough 41 to lean against the stepped surface 14 of the connecting member 1. The upper end face 231 of the annular flange 23 of the support rod 21 leans against the stepped surface 14 steady.

The connecting member 1 is provided with a limit engaging recess 15 and a limit slide recess 16 which are arranged up and down. The engaging member 4 is provided with a limit engaging strip 43 and an engaging plate 44 which are arranged up and down. The limit engaging strip 43 is provided with an engaging hook 431. A side wall of the limit engaging recess 15 is provided with an engaging hole 151. The limit engaging strip 43 of the engaging member 4 is inserted into the limit engaging recess 15. The engaging hook 431 is engaged in the engaging hole 151. The engaging plate 44 is formed with the annular through trough 41. A free end of the engaging plate 44 is inserted into the limit slide recess 16.

An upper portion of the edge of the annular through trough 41 of the engaging member 4 has an inclined chamfer 45, enabling the edge of the annular through trough 41 of the engaging member 4 to be engaged with the lower portion of the annular flange 23 of the support rod 21 smoothly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A one-touch quick-release device of a toilet cover, comprising a connecting member, a retaining member, a drive member, an engaging member, and a turning member; one end of the connecting member being installed to the toilet cover through the turning member, another end of the connecting member being connected with the engaging member, a return elastic member being provided between the engaging member and the connecting member, the connecting member being radially provided with an insertion rod; the retaining member being installed on a toilet, the retaining member being vertically provided with a support rod, the support rod being formed with a central hole for insertion of the insertion rod; characterized in that: an upper end of the support rod is provided with an annular flange, the engaging member is provided with an annular through trough, the annular flange at the upper end of the support rod is inserted through the annular through trough to lean against the connecting member, the insertion rod of the connecting member is inserted into the central hole of the support rod, the engaging member is biased by the return elastic member or is compressed by the drive member to axially move back and forth on the connecting member, along with an axial displacement of the engaging member, an edge of the annular through trough of the engaging member is engaged with a lower portion of the annular flange of the support rod for the connecting member to be retained on the support rod or is released from the lower portion of the annular flange of the support rod for the connecting member to disengage from the support rod;

wherein the central hole of the support rod is provided with a push elastic member to support the insertion rod inserted into the central hole of the support rod; and wherein the central hole of the support rod is a through hole having a top in which an opening is formed and a bottom that is opposite to the opening in an axial direction of the central hole, the bottom being closed by a bottom lid that is opposite to the opening in the axial direction, the push elastic member being received in the through hole through the opening of the top of the through hole such that one end of the push elastic member leans against the bottom lid and another end of the push elastic member leans against the insertion rod of the connecting member to apply a spring force in the axial direction of the through hole for biasing and supporting the insertion rod received in the central hole of the support rod in the axial direction.

2. The one-touch quick-release device of a toilet cover as claimed in claim 1, wherein the annular flange of the support rod is a conical frustum configuration, and an upper portion of the annular flange has a smaller diameter than that of a lower portion of the annular flange.

3. The one-touch quick-release device of a toilet cover as claimed in claim 1, wherein the support rod has a rod body beneath a lower portion of the annular flange, the rod body has a conical frustum shape, and the rod body is gradually enlarged from the lower portion the annular flange to a bottom thereof.

4. The one-touch quick-release device of a toilet cover as claimed in claim 1, wherein the connecting member is axially cut to form a stepped surface, the insertion rod of the connecting member is disposed on the stepped surface and perpendicular to the stepped surface, and the annular flange of the support rod is inserted through the annular through trough to lean against the stepped surface of the connecting member.

5. The one-touch quick-release device of a toilet cover as claimed in claim 1, wherein the connecting member is provided with a limit engaging recess and a limit slide recess which are arranged up and down, the engaging member is provided with a limit engaging strip and an engaging plate which are arranged up and down, the limit engaging strip is provided with an engaging hook, a side wall of the limit engaging recess is provided with an engaging hole, the limit engaging strip of the engaging member is inserted into the limit engaging recess, the engaging hook is engaged in the engaging hole, the engaging plate is formed with the annular through trough, and a free end of the engaging plate is inserted into the limit slide recess.

6. The one-touch quick-release device of a toilet cover as claimed in claim 1, wherein the drive member comprises a sleeve and a button, the connecting member is installed in the sleeve, the engaging member is moveably installed in the sleeve, the sleeve is provided with an opening, the button is confined and installed in the opening, an elastic member is provided between the button and the sleeve, the button is provided with a first push portion, the engaging member is provided with a second push portion to mate with the first push portion, and the sleeve is provided with an aperture for insertion of the support rod of the retaining member.

7. The one-touch quick-release device of a toilet cover as claimed in claim 6, wherein the first push portion of the button is an inclined wedge, and the second push portion of the engaging member is an inclined surface to lean against the first push portion.

* * * * *